US005276002A

United States Patent [19]

Okumura et al.

[11] Patent Number: 5,276,002

[45] Date of Patent: Jan. 4, 1994

[54] IMAGE-RECEIVING SHEET FOR THERMAL DYE-TRANSFER RECORDING

[75] Inventors: Yoshitaka Okumura, Kyoto; Hiromasa Kondo, Ikoma, both of Japan

[73] Assignee: Kanzaki Paper Manufacturing Co., Ltd., Tokyo, Japan

[21] Appl. No.: 691,334

[22] Filed: Apr. 25, 1991

[30] Foreign Application Priority Data

Apr. 27, 1990 [JP] Japan ..... 2-113298

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 5,059,580 10/1991 Shibata et al. ..... 503/227

5,098,883 3/1992 Aono ..... 503/227

*Primary Examiner*—B. Hamilton Hess

*Attorney, Agent, or Firm*—Wenderoth, Lind & Ponack

[57] ABSTRACT

An image-receiving sheet for thermal dye-transfer recording comprising a substrate and an image-receiving layer disposed on said substrate, said image-receiving layer being capable of receiving an image to be transferred from a coloring material-transferring sheet, characterized in that said image-receiving layer is formed of a coating composition comprising an aqueous solution or a water dispersion of a resin having a dyeing property, a carboxy-modified silicone compound, and a multi-functional aziridine derivative.

6 Claims, No Drawings

IMAGE-RECEIVING SHEET FOR THERMAL DYE-TRANSFER RECORDING

FIELD OF THE INVENTION

The present invention relates to an image-receiving sheet for thermal dye-transfer recording. More particularly, it relates to an image-receiving sheet for thermal dye-transfer recording with an improved image-receiving layer formed of a specific composition comprising a resin having a dyeing property ( that is, a so-called dyeable resin), carboxy-modified silicone compound and multi-functional aziridine derivative, which does not cause fusion bonding to a coloring material-transferring sheet upon recording, has an improved record suitability and stably provides a desirable record image.

BACKGROUND OF THE INVENTION

A thermal recording system capable of providing a record image upon input of a signal is widely used in facsimiles, computer terminal printers, printers for measuring instruments, etc., since the device used in the system is relatively easy to handle, low in noise and available at an inexpensive cost.

As the recording medium to be used in such thermal recording system, there is commonly known a thermal recording sheet of a so-called color formation type which is provided with a recording layer capable of undergoing physical and chemical changes to cause color formation by application of heat. However, there are disadvantages for this thermal recording sheet that it is liable to induce undesirable color development either during the fabrication process thereof or during storage thereof; and the image formed thereon is poor in storage stability and is apt to fade upon contact with organic solvents or chemicals. In order to eliminate these problems, there has been proposed a thermal recording system in which a recording medium utilizing a self-colored coloring material is used instead of the color-developing thermosensitive recording sheet. For instance, Japanese Patent Laid-open 51(1976)-15446 discloses a recording system in which a substrate, such as paper, polymer film, etc., coated with a coloring material which is solid or semi-solid at room temperature is superposed on an image-receiving sheet in such a manner that the coloring material on the substrate comes into contact with the image-receiving sheet, and the coloring material on the substrate is heated by a thermal recording head and selectively transferred to the image-receiving sheet to thereby obtain a recorded image.

According to this recording system, the coloring material on the substrate is melted, evaporated and sublimated by application of heat, followed by transferring to the image-receiving sheet to form an image thereon through sticking, adsorption and dye-fixing. One of the admitted features of this recording system is that plain paper may be used as the image-receiving sheet. And, a recording system using a sublimable dye as the coloring material provides an image excelling in resolution. Hence attempts have been made to apply this recording system to full color recording. However, when plain paper is used as the image-receiving sheet, there are disadvantages that the dye-fixing, in particular, is hardly attained and because of this, not only the image recorded becomes poor in color density but also distinguished fading occurs for the recorded image with the passage of time. In order to eliminate these disadvantages, there has been proposed the use of an image-receiving sheet having an image-receiving layer mainly comprising a thermoplastic resin as disclosed in Japanese Patent Laid-open 57(1982)-107885 or U.S. Pat. No. 3,601,484.

Now, the provision of such image-receiving layer mainly comprising a thermoplastic resin provides improvements on recording sensitivity and storage stability to some extent, but there still remain some problems to be solved. For instance, the process of forming the image-receiving layer by dissolving a thermoplastic resin in a solvent is accompanied by not only problems in working efficiency but also a fear of fire disaster. In addition, in the case where a water-soluble or water-dispersible resin is used for the formation of the image-receiving layer, the image recorded on the resultant image-receiving layer is liable to fade when stored under a highly humid environment because of the constituent resin of the image-receiving layer which is likely to absorb moisture from the air. There are other problems in this case that cross-linking agent or/and reactive modifier contained together with the water-soluble or water-dispersible resin in a coating composition for the formation of the image-receiving layer is often reacted with water or reacted with the water-soluble or water-dispersible resin prior to applying the coating composition onto a base sheet or subjecting the coated material to air-drying. Because of this, it is difficult to obtain a stable coating composition which is free of changes in properties and which is capable of providing a desirable image-receiving layer. In order to eliminate these problems, there is a proposal to modify the water-soluble or water-dispersible resin prior to use. However, this proposal is problematic since there is a limit for the kind of an usable resin and, in addition to this, the number of the steps of forming the image-receiving layer is unavoidably increased.

Other than the above, in order to improve the physical properties of the foregoing thermoplastic resin, Japanese Patent Laid-open 61(1986)-277493 or 62(1987)-238791 proposes to make it cross-linked. Further, a number of proposals have been made aiming at improvement in the printability or prevention of fusing with respect to the image-receiving layer. For example, Japanese Patent Laid-open 60(1985)-212374 proposes incorporation of a releasing agent into the image-receiving layer in order to prevent the surface of the coloring material-containing layer of the transfer sheet from being fused with the surface of the image-receiving layer of the recording sheet, resulting in making it impossible to record. Other than this, Japanese Patent Laid-open 62(1987)-222895 proposes use of a resin modified with silicone oil or the like in the preparation of the image-receiving layer.

SUMMARY OF THE INVENTION

The principal object of the present invention is to provide an improved image-receiving sheet for thermal dye-transfer recording which is free from the foregoing problems on the known image-receiving sheet and which stably provides desirable printing images of high optical density without occurrence of fusing between the image-receiving layer ( or recording layer ) of the image-receiving sheet and the coloring material-containing layer (hereinafter referred to as "coloring material layer") of the coloring material-transferring sheet which is often found in the case of the known image-receiving sheet.

Another object of the present invention is to provide an image-receiving sheet for thermal dye-transfer recording which is provided with an improved image-receiving layer which excels in record sensitivity and printability.

A further object of the present invention is to provide an improved image-receiving sheet for thermal dye-transfer recording which stably provides a high quality and clear image and which is maintained in the original state even when stored under highly humid environment for a long period of time.

A still further object of the present invention is to provide an improved image-receiving sheet for thermal dye-transfer recording which is not deteriorated even when stored under severe environment for a long period of time.

A yet further object of the present invention is to provide an improved image-receiving sheet for thermal dye-transfer recording which can be efficiently produced with a high yield by using a coating composition containing a water-soluble or water-dispersible dyeable resin without curing treatment and without any danger of fire disaster.

The present inventors have made intensive studies in order to achieve the above objects and, as a result, found that the above objects can be desirably attained when a coating composition comprised of an aqueous solution or a water dispersion of a dyeable resin, carboxy-modified silicone compound and multi-functional aziridine derivative is used for the formation of the image-receiving layer of an image-receiving sheet for thermal dye-transfer recording. Particularly, the present inventors have found that when said coating composition is used, there can be efficiently obtained a desirable image-receiving sheet for thermal dye-transfer recording with safety by a simple process and the resulting image-receiving sheet is such that it stably exhibits a satisfactory printabilty and provides a high quality and clear image which can be maintained without being deteriorated even when stored under a highly humid environment.

The present invention has been accomplished based on the above finding. The image-receiving sheet for thermal dye-transfer recording according to the present invention comprises a substrate and an image-receiving layer which is disposed on said substrate and which functions to receive a dye to be transferred from a coloring material transferring sheet by application of heat.

DETAILED DESCRIPTION OF THE INVENTION

The principal feature of the image-receiving sheet for thermal dye-transferring recording according to the present invention lies in that the image-receiving layer is composed of a composition comprising a water-soluble or water-dispersible dyeable resin as a main constituent, a cross-linking agent comprising a selected multi-functional aziridine derivative which is capable of contributing to improving the storage stability of an image recorded on the image-receiving layer, and a releasing agent comprising a selected carboxy-modified silicone compound which is capable of contributing to preventing the image-receiving layer of the image-receiving sheet from thermally fusing with the coloring material transferring layer of the transfer sheet upon recording by application of heat.

As the water-soluble or water-dispersible dyeable resin to be used in the present invention, a water-soluble or water-dispersible thermoplastic resin can be desirably used. Specific examples of such thermoplastic resin include polymers of vinyl monomers such as styrene, vinyltoluene, vinyl chloride, acrylic ester, methacrylate ester, acrylonitrile, vinyl acetate, etc.; copolymers comprising at least two different vinyl monomers selected from those vinyl monomers above mentioned; condensation polymers such as polyester, polyamide, polycarbonate, polysulfone, epoxy resin, polyurethane, etc.; and cellulosic resins. These thermoplastic resins can be used either singly or in combination of two or more of them.

In case where necessary, it is possible to use other appropriate resin material together with the above thermoplastic resin. Specific examples of such resin material include methyl cellulose, ethyl cellulose, hydroxypropyl cellulose, starch, polyvinyl alcohol, polyamide resin, phenol resin, melamine resin, urea resin, urethane resin, epoxy resin, silicone resin, etc.

Any of the above-mentioned thermoplastic resins to be used in the present invention has one or more functional groups selected from unsaturated carbonyl groups such as isocyanate group, ester group, ketene group, etc, hydroxy group, mercapto group, primary amine group, and secondary amine group in the molecule. Thus, the thermoplastic resin can be cross-linked through its functional group with the use of a multi-functional aziridine derivative. This situation markedly contributes to improvements not only in the storage stability of an image recorded on the image-receiving layer but also in the moisture resistance of the recorded sheet in the present invention.

Usable as such polyfunctional aziridine derivative are, for example, 1-(2-methyl)aziridine propionic acid 2-ethyl-2 (3-(2-methyl)aziridinyl-1-oxopropoxy)-1-3-propandiyl ester, tris-2,4,6-(1-aziridinyl)-1,3,5-triazine, tris(1-(2-methyl)aziridinyl)phosphine oxide, hexa(1-(2-methyl) aziridinyl)triphosphatriazine, tri-1-aziridinylphosphine oxide, N,N-hexamethylene-1,6-bis(1-aziridinecarboxyamide), N,N-diphenylmethane-4,4-bis(1-aziridinecarboxyamide), trimethylolpropane-tri-$\beta$-aziridinylpropionate, tetramethylolmethane-tri-$\beta$-aziridinylpropionate, N,N-toluene-2,4-bis(1-aziridinecarboxyamide), bisisophthaloyl-1-(2-methylaziridine), tris-1-(2-methylaziridine)phosphine, trimethylolpropane-tri-$\beta$-(2-methylaziridine)propionate, and aziridine polymers obtained by polymerizing these compounds. In the present invention, it is possible to use other aziridine derivatives than those illustrated in the above.

The coating composition incorporated with a water-soluble aziridine derivative selected from those mentioned in the above has such a property that crosslinking reaction hardly occurs when the pH value thereof is relatively high and the crosslinking reaction proceeds when the PH value thereof is reduced upon drying the coating composition. In view of this, in order to obtain a desirable coating composition containing the aziridine derivative for the formation of the image-receiving layer (recording layer) of the image-receiving sheet according to the present invention, it is desired to use a volatile material such as ammonia or the like, which is capable of making the coating composition alkaline, together with the aziridine derivative. In the case of using such volatile material together with the aziridine derivative, the resulting coating composition becomes such that has a satisfactory coating property, can be maintained in a stable state without causing the crosslinking reaction upon preparing the coating composition and applying said composition on a substrate and that causes the crosslinking reaction at the first time upon drying the coating composition after it is applied on the substrate.

In the present invention, it is also an important factor to use the foregoing releasing agent comprising carboxy-modified silicone compound in addition to combined use of the dyeable thermoplastic resin and the aziridine derivative capable of causing crosslinking reaction for said thermoplastic resin. The carboxy-modified siiicone compound to be used in the present invention includes commercially available so-called carboxy-modified silicone oils having carboxy groups at the terminal ends or in the molecule of a compound having a silicone skeltone. Specific examples are carboxy-modified silicone oils commercially available under trademark names of X-22-3701E, X-22-3710 (product by Shinetsu Chemical Co., Ltd. ), etc. These carboxy-modified silicone oils are dissolved or dispersed in water upon use. Other than these, it is possible to use carboxy-modified silicone emulsions commercially available under trademark names of BY-22-820 (product by Toray Silicone Co., Ltd. ), X-51-789 (product by Shinetsu Chemical Co., Ltd. ), etc.

The use of the specific releasing agent makes the image-receiving layer of the image-receiving sheet for thermal dye-transfer recording according to the present invention not to be fused with the coloring material-transferring layer of the transfer sheet upon recording by application of heat.

Particularly for this situation, as above described, the aziridine derivative capable of functioning as a so-called crosslinking agent to be incorporated into the image-receiving layer in the present invention has a property that causes crosslinking reaction with one or more compounds having one or more functional groups. Especially when a compound having a carboxy group exists together with the aziridine derivative, the aziridine groups easily ring-cleave, causing an addition reaction. In this case, when the reaction atmosphere is situated in the acidic side, the crosslinking reaction is further promoted. Because of this, the dyeable thermoplastic resin, the aziridine derivative and the carboxy-modified silicone compound are mutually bonded with each other at the time of forming the image-receiving layer without release of the carboxy-modified silicone compound therefrom. As a result, there is afforded a desirable image-receiving sheet for thermal dye-transfer recording which is free of bonding with the coloring material-transferring layer of the transfer sheet upon recording by application of heat. The sheet excels in printability and provides a high quality recorded image which can be maintained in the original state without being deteriorated even when stored under a highly humid environment for a long period of time.

As above described, the object of the present invention can be attained by causing chemical reactions among the dyeable thermoplastic resin, the multi-functional aziridine derivative compound and the carboxy-modified silicone compound to thereby crosslink them. There is not a particular limitation for the mixing ratio of the three materials. However, it is important to determine the mixing ratios of the three materials so that they are chemically reacted with each other to cause crosslinkage among them without leaving unreacted residues of the multi-functional aziridine derivative and/or the carboxy-modified silicone compound. In the case where unreacted residues of the multi-functional aziridine derivative and/or the carboxy-modified silicone compound are present, the resulting image-receiving layer becomes accompanied with greasiness and is practically unacceptable.

In a specific embodiment in the case of using, for example, 1-(2-methyl)aziridine propionic acid, 2-ethyl-2(3-(2-methyl)aziridinyl-1-oxopropoxy)-1-3-propandiyl ester as the multi-functional aziridine derivative, generally 3 to 5000 parts of the carboxy-modified silicone compound and 3 to 5000 parts of the aziridine derivative are used versus 100 parts of the dyeable thermoplastic resin, in terms of dry solids content. In any case, these mixing ratios should be properly determined depending upon the kind of the aziridine derivative to be used with due regard to the fact that they are chemically reacted with each other to cause crosslinkage among them without leaving unreacted residues of the multi-functional aziridine derivative and/or the carboxy-modified silicone compound. As for the mixing ratio of the dyeable thermoplastic resin, when it is made relatively smaller in comparison with that of each of the carboxy-modified silicon compound and the aziridine derivative, the release properties of the resulting image-receiving sheet is somewhat improved but there is a tendency for an image recorded thereon to be unsatisfactory in storage stability at high temperature. In view of this, the mixing ratio of the dyeable thermoplastic resin should be preferably adjusted in the range of 50 to 90 parts versus the whole solids content of the image-receiving layer.

In the case where it is desired for the image-receiving sheet for thermal dye-transfer recording according to the present invention to be endowed with a further improved writing property, the coating composition for the image-receiving layer thereof may be incorporated with an inorganic pigment such as natural ground calcium carbonate, precipitated calcium carbonate, talc, clay, natural or synthetic silicic acid, titanium dioxide, aluminum hydroxide, zinc oxide, etc. or an organic pigment such as urea-formaldehyde resin powder, etc. Further, the coating composition for the image-receiving layer may be incorporated with an appropriate additive in the case where it is desired for the image-receiving sheet for thermal dye-transfer recording according to the present invention to be endowed with other functions. Examples of such additives include ultraviolet ray absorbing agents, antioxidants, antistatic agents, or other releasing agents and lubricants.

The image-receiving layer of the image-receiving sheet for thermal dye-transfer recording according to the present invention is formed by applying the coating composition for the image-receiving layer on the surface of a substrate, followed by drying. The method of application is not specifically limited. For example, wire bar coating, blade coating, air knife coating or gravure coating may be optionally used. The amount of the coating composition to be applied on the substrate at the time of forming the image-receiving layer is not specifically limited but should be properly determined depending upon the situation. In general, it is desired to be adjusted in the range of 2 to 15 $g/m^2$.

In a preferred embodiment, the surface of the substrate on which the image-receiving layer is to be formed is smoothed prior to applying the coating composition for the image-receiving layer thereon. In an alternative, the surface of the dried coating composition to be the image-receiving layer is smoothed. The smoothing may be performed by way of heat and pressure treatment using an appropriate means such as a supercalender. In any of these two cases, the resulting image-receiving sheet for thermal dye-transfer recording becomes one that is further improved especially with respect to recording sensitivity and is capable of providing a further improved high quality recorded image.

The substrate of the image-receiving sheet for thermal dye-transfer recording according to the present invention may be a member selected from plain paper, synthetic paper, synthetic resin film and laminates of these papers and/or films. Of these members, the plain paper is most desirable particularly in view of heat resistance. The plain paper as herein referred to is, for example, a paper comprising cellulose pulp as a main component, a wet-strength agent, sizing agent, fixing agent and inorganic or organic filler by an ordinary paper-making process and other papers obtained by subjecting the above papers to appropriate treatment for improving their surface physical properties, for instance, by sizepressing them with oxidized starch or providing them with a prime coat mainly comprising a pigment such as clay or the like. Of these papers, papers having excellent surface smoothness such as art paper, coated paper and cast-coated paper are most desirable.

Other than those above mentioned, it is possible to use papers comprising the above papers having provided thereon a rubbery elastic layer capable of adding heat insulating properties or cushioning characteristics of providing desirable contact with the transfer sheet. It is also possible to use papers comprising the above papers to which have been added a brightener or white pigment in order to improve color reproductivity upon recording.

Further, as the substrate, it is possible to use laminates comprising a plurality of synthetic papers which are laminated, laminates comprising a plurality of synthetic resin films which are laminated, laminates comprising synthetic paper and synthetic resin film which are laminated, and laminates comprising synthetic paper and/or synthetic resin film which are laminated on plain paper since these laminates excel in smoothness and uniformity.

The image-receiving sheet for thermal dye-transfer recording according to the present invention exhibits an extremely excellent performance, particularly when combined with a color material-transferring sheet containing a heat-sublimable dye.

The term "heat-sublimable dye" as herein referred to means a means a coloring material (dye) which is not transferred even in contact with the image-receiving sheet under the usual handling conditions but, when heated to 60° C. or higher, is transferred to the image-receiving sheet through melting, evaporation, and sublimation. Specific examples of such heat-sublimable dyes are dispersing dyes represented by azo dyes, nitro dyes, anthraquinone dyes and quinoline dyes; basic dyes represented by triphenylmethane dyes and fluoran dyes; and oil-soluble dyes.

The image-receiving sheet for thermal dye-transfer recording according to the present invention is applicable not only to a thermal recording system in which the sheet is subjected to contact heat with a hot plate or a thermal head of a thermal printing unit but also to other thermal recording system of non-contact heat type in which the sheet is subjected to heat radiation with a infrared lamp or a YAG laser.

DESCRIPTION OF THE PREFERRED EMBODIMENTS

The present invention will be described in more detail with reference to the following examples, which are not intended to restrict the scope of the invention. In the examples, "parts" and "%" mean "parts by weight" and "wt %", respectively, unless otherwise defined.

EXAMPLE 1

As the substrate, there was provided a commercially available art paper of 157 g/m$^2$ (trademark name: SAKINFUJI (135), product by Kanzaki Paper Manufacturing Co., Ltd. ).

A coating composition for the formation of the image-receiving layer was prepared by adding 2 parts of a 28% aqueous ammonia to 90 parts of polyester resin water dispersion (trademark name: Pesresin 2000, nonvolatile matter content: 20%, product by Takamatsu Oil & Fats Co., Ltd.), and admixing the resultant with 2 parts of aziridine derivative (trademark name: Ionac PFAZ-322, oily material of 100% in concentration, product by SYBRON CHEMICALS Inc. of U.S.A.) and 6 parts of caboxy-modified silicone microemulsion (trademark name: X-51-789, 20% water dispersion, product by Shinetsu Chemical Co., Ltd.).

The coating composition thus obtained was applied on the surface of the above art paper in an amount to be 5 g/m$^2$ when dried, followed by drying at 100° C. for 30 seconds in an oven dryer, to thereby form an image-receiving layer on the art paper.

The resultant was then passed through a supercalender comprising a metal roll and an elastic roll at a linear pressure of 200 Kg/cm to perform smoothing treatment for the image-receiving layer. Thus, there was obtained an image-receiving sheet for thermal dye-transfer recording.

EXAMPLE 2

There was prepared an image-receiving sheet for thermal dye-transfer recording by repeating the procedures of Example 1, except for replacing the coating composition by a coating composition obtained by adding 2 parts of a 28% aqueous ammonia to 85 parts of modified polyester resin water dispersion (trademark name: Pesresin A-210, nonvolatile matter content: 30%, product by Takamatsu Oil & Fats Co., Ltd.), and admixing the resultant with 3 parts of aziridine derivative (trademark name: KT-107, oily material of 100% in concentration, product by Toagosei Chemical Industry Co., Ltd.) and 10 parts of carboxy-modified silicone microemulsion (trademark name: X-51-789, 20% water dispersion, product by Shinetsu Chemical Co., Ltd. ).

EXAMPLE 3

There was prepared an image-receiving sheet for thermal dye-transfer recording by repeating the procedures of Example 1, except for replacing the coating composition by a coating composition obtained by adding 2 parts of a 28% aqueous ammonia to 80 parts of polyester resin water dispersion (trademark name: Vylonal MD-1200, nonvolatile matter content: 40%, product by Toyobo Co., Ltd.), and admixing the resultant with 4 parts of aziridine derivative (trademark name: Ionac PFAZ-322, oily material of 100% in concentration, product by SYBRON CHEMICALS Inc. of U.S.A.) and 14 parts of carboxy-modified silicone microemulsion (trademark name: X-51-789, 20% water dispersion, product by Shinetsu Chemical Co., Ltd. ).

EXAMPLE 4

There was prepared an image-receiving sheet for thermal dye-transfer recording by repeating the procedures of Example 1, except for replacing the coating composition by a coating composition obtained by adding 2 parts of a 28% aqueous ammonia to 80 parts of modified polyester resin water dispersion (trademark name: Pesresin A-210, nonvolatile matter content: 30%, product by Takamatsu Oil & Fats Co., Ltd.), dispersing 5 parts of anatase type titanium dioxide in powdery form (trademark name: FA-55W, product by Furukawa Mining Co., Ltd.) into the resultant to obtain a dispersion, and admixing the dispersion with 3 parts of aziridine derivative (trademark name: Ionac PFAZ-322, oily material of 100% in concentration, product by SYBRON CHEMICALS Inc. of U.S.A.) and 10 parts of carboxy-modified silicone microemulsion (trademark name: X-51-789, 20% water dispersion, product by Shinetsu Chemical Co., Ltd. ).

EXAMPLE 5

As the substrate, there was provided a commercially available synthetic paper of 150 μm in thickness (trademark name: YUPO FPG-150, product by Ohji Yuka Goseishi Kabushiki Kaisha).

A coating composition for the formation of the image-receiving layer was prepared by adding 2 parts of a 28% aqueous ammonia to 80 parts of modified polyester resin water dispersion (trademark name: Pesresin A-210 Revision, nonvolatile matter content: 25%, product by Takamatsu Oil & Fats Co., Ltd.), dispersing 5 parts of anatase type titanium dioxide pigment in powdery form (trademark name: FA-55W, product by Furukawa Mining Co., Ltd.) into the resultant to obtain a dispersion, and admixing the dispersion with 3 parts of aziridine derivative (trademark name: Ionac PFAZ-322, oily material of 100% in concentration, product by SYBRON CHEMICALS Inc. of U.S.A.) and 10 parts of carboxy-modified silicone microemulsion (trademark name: X-51-789, 20% water dispersion, product by Shinetsu Chemical Co., Ltd.).

The coating composition thus obtained was applied on the surface of the above synthetic paper in an amount to be 5 g/m$^2$ when dried, followed by drying at 80° C. for a minute in an oven dryer, to thereby form an image-receiving layer on the synthetic paper.

The resultant was then passed through a supercalender comprising a metal roll and an elastic roll at a linear pressure of 200 Kg/cm to perform smoothing treatment for the image-receiving layer. Thus, there was obtained an image-receiving sheet for thermal dye-transfer recording.

EXAMPLE 6

The procedures of Example 5 were repeated, except that the modified polyester resin dispersion was replaced by a polyester resin dispersion (trademark name: PE-25, nonvolatile matter content: 25%, product by Tokuyama Soda Co., Ltd.), to thereby obtain an image-receiving sheet for thermal dye-transfer recording.

EXAMPLE 7

The procedures of Example 5 were repeated, except that the modified polyester resin dispersion was replaced by a polyesteric urethane ionomer resin dispersion (trademark name: Hydran AP-40, nonvolatile matter content: 23%, product by Dainippon Ink & Chemicals, Inc.), to thereby obtain an image-receiving sheet for thermal dye-transfer recording.

EXAMPLE 8

The procedures of Example 5 were repeated, except that the modified polyester resin dispersion was replaced by a polyamide epoxy resin water dispersion (trademark name: Sumirase Resin 650, 30% water dispersion, product by Sumitomo Chemical Co., Ltd.), to thereby obtain an image-receiving sheet for thermal dye-transfer recording.

EXAMPLE 9

There was prepared an image-receiving sheet for thermal dye-transfer recording by repeating the procedures of Example 1, except for replacing the coating composition by a coating composition obtained by adding 2 parts of a 28% aqueous ammonia to 90 parts of polyester resin water dispersion (trademark name: Pluscoat Z-446, 25% water dispersion, product by Gooh Kagaku Kohgyo Kabushiki Kaisha), and admixing the resultant with 3 parts of aziridine derivative (trademark name: Ionac PFAZ-322, oily material of 100% in concentration, product by SYBRON CHEMICALS Inc. of U.S.A.) and 5 parts of carboxy-modified silicone emulsion (trademark name: BY22-820, 35% water dispersion, product by Toray Silicone Co., Ltd.).

EXAMPLE 10

There was prepared an image-receiving sheet for thermal dye-transfer recording by repeating the procedures of Example 1, except for replacing the coating composition by a coating composition obtained by adding 2 parts of a 28% aqueous ammonia to 60 parts of polyester resin water dispersion (trademark name: Pluscoat Z-446, 25% water dispersion, product by Gooh Kagaku Kohgyo Kabushiki Kaisha), and admixing the resultant with 20 parts of aziridine derivative (trademark name: Ionac PFAZ-322, oily material of 100% in concentration, product by SYBRON CHEMICALS Inc. of U.S.A.) and 18 parts of carboxy-modified silicone emulsion (trademark name: BY-22-820, product by Toray Silicone Co., Ltd.).

COMPARATIVE EXAMPLE 1

The procedures of Example 2 are repeated, except that 10 parts of a 20% water dispersion of alcohol-modified silicone oil (trademark name: SF-8427, oily material of 100% in concentration, product by Toray Silicone Co., Ltd.) was used instead of the carboxy-modified silicone microemulsion, to thereby obtain an image-receiving sheet for thermal dye-transfer recording.

COMPARATIVE EXAMPLE 2

The procedures of Example 2 are repeated, except that 7 parts of epoxy-modified silicone emulsion (trademark name: Polon MF-11B, 30% water dispersion, product by Shinetsu Chemical Co., Ltd.) was used instead of the carboxy-modified silicone microemulsion, to thereby obtain an image-receiving sheet for thermal dye-transfer recording.

COMPARATIVE EXAMPLE 3

The procedures of Example 5 were repeated, except that 4 parts of aqueous melamine resin crosslinking agent (trademark name: Sumitex Resin M3, water dispersion of 80% in nonvolatile matter content, product by Sumitomo Chemical Co., Ltd.) was used instead of the aziridine derivative (trademark name: Ionac PFAZ-322), to thereby obtain an image-receiving sheet for thermal dye-transfer recording.

Comparative Example 4

The procedures of Comparative Example 3 were repeated, except that 0.4 part of melamine curing catalyst (trademark name: Sumitex Accelerator ACX, product by Sumitomo Chemical Co., Ltd.) was additionally used for the preparation of a coating composition for the formation of an image-receiving layer, to thereby obtain an image-receiving sheet for thermal dye-transfer recording.

COMPARATIVE EXAMPLE 5

There was prepared an image-receiving sheet for thermal dye-transfer recording by repeating the procedures of Example 5, except for replacing the coating composition by a coating composition obtained by dispersing 5 parts of anatase type titanium dioxide pigment in powdery form (trademark name: FA-55W, product by Furukawa Mining Co., Ltd.) into 80 parts of a polyesteric urethane ionomer resin dispersion (trademark name: Hydran AP-40, nonvolatile matter content: 23%, product by Dainippon Ink & Chemicals, Inc.) to obtain a dispersion, admixing this dispersion with 15 parts of aqueous isocyanate crosslinking agent (trademark name: Elastoron H-38, water dispersion with a 20% effective ingredient, product by Daiichi Kogyo Seiyaku Co., Ltd.) and 10 parts of a 20% water dispersion of alcohol-modified silicone oil (trademark name: SF-8427, oily material of 100% in concentration, product by Toray Silicone Co., Ltd.) to obtain a mixture, adjusting the pH value of the mixture with the use of a 10% aqueous solution of acetic acid to 6, and adding 0.03 part of isocyanate crosslinking catalyst (trademark name: Elastron catalyst 64, product by Daiichi Kogyo Seiyaku Co., Ltd.) to the resultant.

EVALUATIONS

Each of the 15 kinds of image-receiving sheets for thermal dye-transfer recording which were obtained in the above Examples 1 to 10 and the above Comparative Examples 1 to 5 was evaluated by subjecting it to image printing using a coloring material-transferring sheet.

The coloring material-transferring sheet was prepared in the following manner.

That is, firstly, as the base member for the coloring material-transferring sheet, there was provided a six micron thick polyethylene terephthalate film.

Then, 0.45 part of a blue colored thermally sublimable dye (trademark name: KST-B-714, product by Nippon Kayaku Co., Ltd.) and 0.4 part of polyvinyl butyral resin (trademark name: S-lec BX-1, product by Sekisui Chemical Co., Ltd.) were added to a solvent mixture comprising 4.6 parts of methyl ethyl ketone and 4.6 parts of toluene while agitating in a mixer to obtain an ink composition for the formation of a coloring material-transferring layer. The ink composition thus obtained was applied onto the above film (the rear side of the film having been subjected heat-resisting treatment) in an amount to be 1.0 g/m$^2$ when dried by means of a wire bar, followed by drying to thereby obtain a coloring material-transferring sheet.

For evaluation, the coloring material-transferring sheet thus obtained was superposed on the image-receiving sheet, followed by printing with application of heat by a thermal head under conditions of a voltage of 12 V and a pulse width of 2 to 8 msec, to thereby form a recorded image on the image-receiving layer of the image-receiving sheet. And the resultant was stored for 100 hours under environmental conditions of 50° C. and 90% RH and also under environmental condition of 70° C. in order to observe the situation of changes in the quality of the recorded image upon storage in a severe environment.

Particularly, stability of the coating composition for the image-receiving layer, storage stability of the recorded image at high humidity and storage stability of the recorded image at high temperature were evaluated, respectively in the following manner. The evaluated results were collectively shown in Table.

1. Evaluation with respect to the stability of the coating composition for the image-receiving layer.

Firstly, the presence of cloudiness and the presence of segregation were observed by visual observation for the coating composition for the image-receiving layer immediately after its preparation, after having been stored at 22° C. for 6 hours, and after having been stored at 22° C. for 24 hours.

Then, the release properties of the surface of the image-receiving layer formed of the coating composition from the surface of the coloring material-transferring layer upon printing were observed visually.

2. Evaluation with respect to the storage stability of the recorded image at high humidity.

Observation was made of the image recorded on the image-receiving layer with respect to the situation of its bleeding when stored under the atmosphere of 50° C. and 90% RH for 100 hours by a magnifying lens with a magnification of 25.

3. Evaluation with respect to the storage stability of the recorded image at high temperature.

Observation was made of the image recorded on the image-receiving layer with respect to the situation of its bleeding when stored under the atmosphere of 70° C. for 100 hours by a magnifying lens with a magnification of 25.

From the evaluated results shown in the Table, it has been recognized that any of the coating compositions for the image-receiving layer obtained in Examples 1 to 10 excels in stability and any of the image-receiving sheets for thermal dye-transfer recording formed of those coating compositions excels in recording stability.

TABLE 1

| | releasing properties | stability at high humidity | stability at high temperature |
|---|---|---|---|
| Example 1 | ◎ | ◎ | ◎ |
| Example 2 | ○ | ○ | ○ |
| Example 3 | ◎ | ○ | ○ |
| Example 4 | ○ | ○ | ○ |
| Example 5 | ◎ | ○ | ○ |
| Example 6 | ◎ | ◎ | ◎ |
| Example 7 | ○ | ○ | ○ |
| Example 8 | ○ | ○ | ○ |
| Example 9 | ○ | ○ | ○ |
| Example 10 | ◎ | ○ | Δ |
| Comparative Example 1 | Δ | Δ | ○ |
| Comparative Example 2 | application was impossible because of changes in quality | | |
| Comparative Example 3 | X | X | X |

TABLE 1-continued

| | releasing properties | stability at high humidity | stability at high temperature |
|---|---|---|---|
| Comparative Example 4 | X | X | X |
| Comparative Example 5 | X | X | X |

◎: Excellent
○: good
Δ: seems practically acceptable
X: not acceptable

What we claim is:

1. In an image-receiving sheet for thermal dye-transfer recording comprising a substrate and an image-receiving layer disposed on said substrate, said image-receiving layer being capable of receiving a coloring material-transferring sheet, the improvement wherein said image-receiving layer comprises a layer formed on said substrate by applying thereto a coating composition comprising (a) a water-soluble or water-dispersible resin having a dyeing property as the main constituent, (b) a water-soluble or water-dispersible carboxy-modified silicone compound, (c) a multi-functional aziridine crosslinking compound, and (d) ammonia, and drying said coating composition.

2. An image-receiving sheet for thermal dye-transfer recording according to claim 1, wherein the coating composition has a pH value of at least 10.

3. An image-receiving sheet for thermal dye-transfer recording according to claim 1, wherein the resin having a dyeing property is polyester resin.

4. An image-receiving sheet for thermal dye-transfer recording according to claim 3, wherein the coating composition contains the resin having a dyeing property in a solid content of 50 to 90 percent by weight versus the total solids content of the composition.

5. An image-receiving sheet for thermal dye-transfer recording according to claim 1, wherein the coating composition contains the resin having a dyeing property in a solid content of 50 to 90 percent by weight versus the total solids content of the composition.

6. An image-receiving sheet for thermal dye-transfer recording according to claim 1, wherein the multi-functional aziridine crosslinking compound is selected from the group consisting of 1-(2-methyl)aziridine propionic acid2-ethyl-2(3-(2-(methyl)-aziridinyl-1-1-oxopropoxy)-1-3-propanediyl ester,
tris-2,4,5-(1-aziridinyl)-1,3,5-triazine,
tris(1-(2-methyl)aziridinyl)phosphine oxide,
hexa(1-(2-methyl)aziridinyl)triphosphatriazine,
tri-1-aziridinylphosphine oxide,
N,N-hexamethylene-1,6-bis(1aziridinecarboxyamide),
N,N-diphenylmethane-4,4-bis(1-aziridinecarboxyamide,
trimethylolpropane-tri-β-aziridinylpropionate,
tetramethylolmethane-tri-β-aziridinylpropionate,
N,N-toluene-2,4-bis(1-aziridinecarboxyamide),
bisisophthaloyl-1-1-(2-methylaziridine),
tris-1-(2-methylaziridine)phosphine, and
trimethylolpropane-tri-β(2-methylaziridine)propionate.

* * * * *